US005990671A

United States Patent [19]

Nagata

[11] Patent Number: 5,990,671

[45] Date of Patent: Nov. 23, 1999

[54] CONSTANT POWER VOLTAGE GENERATOR WITH CURRENT MIRROR AMPLIFIER OPTIMIZED BY LEVEL SHIFTERS

[75] Inventor: Kyoichi Nagata, Tokyo, Japan

[73] Assignee: NEC Corporation, Tokyo, Japan

[21] Appl. No.: 09/129,408

[22] Filed: Aug. 5, 1998

[30] Foreign Application Priority Data

Aug. 5, 1997 [JP] Japan ..... 9-210852

[51] Int. Cl.[6] ..... G05F 3/16

[52] U.S. Cl. ..... 323/313; 323/315

[58] Field of Search ..... 323/313, 315

[56] References Cited

U.S. PATENT DOCUMENTS

| | | | |
|---|---|---|---|
| 3,617,859 | 11/1971 | Dobkin | 323/313 |
| 4,088,941 | 5/1978 | Wheatley | 323/313 |
| 4,103,219 | 7/1978 | Wheatley | 323/313 |
| 4,769,589 | 9/1988 | Rosenthal | 323/315 |
| 5,373,226 | 12/1994 | Kimura | 323/313 |
| 5,521,544 | 5/1996 | Hatanaka | 323/315 |
| 5,684,394 | 11/1997 | Marshall | 323/315 |
| 5,825,168 | 10/1998 | Kimber | 323/315 |
| 5,900,773 | 5/1999 | Susak | 323/315 |

FOREIGN PATENT DOCUMENTS

| | | | |
|---|---|---|---|
| 7-211869 | 8/1995 | Japan | H01L 27/04 |

*Primary Examiner*—Jeffrey Sterrett
*Attorney, Agent, or Firm*—Young & Thompson

[57] ABSTRACT

A constant power voltage generator produces an internal power voltage from an external power voltage, and includes a current mirror amplifier for producing a control signal representative of the magnitude of potential difference between a first input node and a second input node, a reference voltage generator for producing a reference voltage, a first level shifter for supplying a step-down reference voltage to the first input node and a second level shifter for supplying a step-down power voltage to the second input node, wherein each of the first and second level shifters is implemented by a series combination of field effect transistors so as to easily optimize the potential levels at the first and second input nodes by changing the channel resistance of the field effect transistors.

19 Claims, 7 Drawing Sheets

CONSTANT POWER VOLTAGE GENERATOR WITH CURRENT MIRROR AMPLIFIER OPTIMIZED BY LEVEL SHIFTERS

FIELD OF THE INVENTION

This invention relates to a constant power voltage generator and, more particularly, to a constant power voltage generator with a current mirror amplifier optimized by associated level shifters.

DESCRIPTION OF THE RELATED ART

Semiconductor device manufacturers have scaled down circuit components of a semiconductor ultra large scale integrated circuit such as a dynamic random access memory device, and the semiconductor ultra large scale integrated circuit requires a step-down voltage for the miniature circuit components, because the high power voltage is liable to damage the miniature circuit components. A 256 megabit dynamic random access memory device and the advanced devices are equipped with a constant voltage generator, which produces step-down voltage of 2.0 volts from external power voltage of 2.5 volts.

The prior art internal constant power voltage generator is broken down into a reference voltage generator and a current mirror amplifier. The reference voltage generator produces reference voltage from the external power voltage, and is supplied to the current mirror amplifier. The current mirror amplifier negatively feeds back internal power voltage, and carries out the differential amplification so as to keep the internal power voltage constant. However, if the potential difference between the external power voltage and the internal power voltage is small, the prior art internal constant voltage generator does not exhibit large current supply capability.

In order to improve the small current supply capability under the small potential difference between the external power voltage and the internal power voltage, an internal step-down power generator is disclosed in Japanese Patent Publication of Unexamined Application No. 7-211869. FIG. 1 illustrates the prior art internal step-down power generator. The prior art internal step-down power generator largely comprises a reference voltage generator 1, a driver 2, two level shifters 3/4, a current mirror amplifier 5 and a phase compensating circuit 6, and the step-down power voltage is supplied to internal circuits 7 of a dynamic random access memory device.

The reference voltage generator 1 is connected between an external power voltage line VEXT and a ground line GND, and produces reference voltage from the external power voltage. The reference voltage is supplied to the driver 2. The driver 2 is also powered with the external power voltage, and increases the amount of current. The driver 2 supplies the reference voltage Vref through a reference voltage line VREF to the level shifter 3.

The level shifter 3 includes a series of n-channel enhancement type load transistors Qn1/Qn2 connected between the reference voltage line VREF and the ground line GND. The n-channel enhancement type load transistor Qn1 has the gate drain electrodes connected to the reference voltage line VREF, and a constant power voltage line VCNT is connected to the gate electrode of the n-channel enhancement type load transistor Qn2. Thus, the n-channel enhancement type load transistor Qn1 pulls down the potential level from the reference voltage line VREF to an output node N1. The n-channel enhancement type load transistor Qn2 serves as a constant current source between the output node N1 and the ground voltage line GND, and has a gate width much narrower than that of the n-channel enhancement type load transistor Qn1. A phase compensating capacitor 8 is connected between the reference voltage line VREF and the current mirror amplifier 5, and reference voltage Vref' is supplied from the output node N1 to a node N2 between the phase compensating capacitor 8 and the current mirror amplifier 5. The phase compensating capacitor 8 compensates the phase difference between the reference voltage line VREF and the node N2, and serves as if it transfers the reference voltage Vref' to the node N2 at a high frequency range.

The current mirror amplifier 5 includes a series combination of a p-channel enhancement type field effect transistor Qp1 and an n-channel enhancement type field effect transistor Qn3 connected between the external power supply line VEXT and a common node N3, another series combination of a p-channel enhancement type field effect transistor Qp2 and an n-channel enhancement type field-effect transistor Qn4 connected in parallel to the series combination and an n-channel enhancement type field effect transistor Qn5 connected between the common node N3 and the ground line GND. The gate electrodes of the p-channel enhancement type field effect transistors Qp1/Qp2 are connected to the drain node N4 of the p-channel enhancement type field effect transistor Qp2, and the drain node of the other p-channel enhancement type field effect transistor Qp1 serves as an output node N5. The gate electrode of the n-channel enhancement type field effect transistor Qn3 is connected to the node N2, and the gate electrode of the n-channel enhancement type field effect transistor Qn4 is connected through a phase compensating capacitor 9 to the level shifter 4. The constant voltage line VCNT is connected to the gate electrode of the n-channel enhancement type field effect transistor Qn5, and the n-channel enhancement type field effect transistor Qn5 serves as a constant current source. The phase compensating capacitor 9 behaves as similar to the phase compensating capacitor 8.

The level shifter 4 is similar in circuit configuration to the level shifter 3, and includes a series of n-channel enhancement type load transistors Qn6/Qn7. The series combination of the n-channel enhancement type load transistors Qn6/Qn7 is connected between an internal step-down power voltage line VINT and the ground line GND.

The prior art internal step-down voltage generator further comprises a p-channel enhancement type field effect transistor Qp3 connected between the external power supply line VEXT and the internal power supply line VINT, and the phase compensating circuit 6 is connected between the internal power supply line VINT and the ground line GND. The output node N5 is connected to the gate electrode of the p-channel enhancement type field effect transistor Qp3, and the phase compensating circuit 6 includes a series combination of a resistor 10 and a capacitor 11 connected between the internal power supply line VINT and the ground line GND. The phase compensating circuit 6 aims at restriction of oscillation due to noise supplied from the external power supply line VEXT and the internal circuits 7 and a feedback loop in the prior art step-down power voltage generator. The p-channel enhancement type field effect transistor Qp3 has a gate width of the order of several thousands microns, and the resistor 10 and the capacitor 11 have the resistance of several ohms to tends ohms and the capacitance of hundreds to thousands pF.

The prior art internal step-down power generator behaves as follows. The reference voltage generator 1 determines the reference voltage level Vref, and the driver 2 supplies the current at the reference voltage Vref to the reference voltage line VREF. The reference voltage Vref is applied to the gate electrode of the n-channel enhancement type load transistor Qn1 and the phase compensating capacitor 8, and the current flows through the n-channel enhancement type load transistors Qn1/Qn2. The n-channel enhancement type load transistor Qn2 is much narrower in gate width than the other n-channel enhancement type field effect transistor Qn1, and the potential level Vref' at the output node N1 is regulated to (Vref−Vth) where Vth is the threshold of the n-channel enhancement type field effect transistor Qn1. The reference level Vref' is supplied from the output node N1 to the gate electrode of the n-channel enhancement type field effect transistor Qn3.

Similarly, the level shifter 4 supplies potential level (Vint−Vth) from the output node N6 to the gate electrode of the n-channel enhancement type field effect transistor Qn4. The current mirror amplifier 5 increases the magnitude of the potential difference between the gate electrode of the n-channel enhancement type field effect transistor Qn3 and the gate electrode of the n-channel enhancement type field effect transistor Qn4, and the potential level at the output node N5 is indicative of the result of the differential amplification. The potential level is supplied from the output node N5 to the gate electrode of the p-channel enhancement type field effect transistor Qp3, and the p-channel enhancement type field effect transistor Qp3 regulates the amount of current supplied to the internal power supply line VINT so as to keep the internal step-down power voltage constant.

Assuming now that the internal step-down power voltage Vint is lower than the reference voltage Vref by Δ V, the level shifters 3/4 supply the reference voltage Vref'=(Vref−Vth) and the potential level (Vint−Vth−Δ V) to the current mirror amplifier 5, and the potential difference Δ V is applied between the gate electrode of the n-channel enhancement type field effect transistor Qn3 and the gate electrode of the n-channel enhancement type field effect transistor Qn4. If the gain of the current mirror amplifier 5 is "A", the current mirror amplifier 5 decreases the potential level at the gate electrode of the p-channel enhancement type field effect transistor Qp3 by (A×Δ V), and the p-channel enhancement type field effect transistor Qp3 increases the current supplied to the internal power supply line VINT. As a result, the potential level on the internal power supply line VINT is recovered to Vref. If the reference voltage Vref is adjusted to 2.0 volts, the prior art internal step-down power generator keeps the step-down power voltage Vint at 2.0 volts.

Even if the potential difference between the external power voltage Vext and the step-down power voltage Vint is small, it is possible to make the input voltages to the current mirror amplifier 5 lower, and the lower input voltages increase the gain of the feedback loop for the step-down power voltage Vint. This results in the increase of the current driving capability through the internal step-down power line VINT. Moreover, the phase compensating capacitors 8/9 achieve the phase compensation at high frequency. However, a problem is encountered in the prior art internal step-down power generator in that the level shifter can not optimize the input voltage levels to the current mirror amplifier 5. The potential levels at the output nodes N1/N6 are determined by the threshold level of the n-channel enhancement type load transistors Qn1/Qn6, and are not always optimum.

If the level shifters 3/4 are implemented by resistor strings, the input voltages may be arbitrary adjusted to optimum levels. However, the resistor strings are required to have thousands ohms, and the resistance is unavoidably dispersed. As a result, the input voltages tend to be deviated from the optimum levels. Moreover, the large resistance and parasitic capacitance results in large time constant, and the level shifters are liable to oscillate.

Another problem inherent in the prior art internal step-down power generator is wide occupation area on a semiconductor chip due to the driver 2. User requests the semiconductor device manufacturer to reduce the current consumption of the semiconductor dynamic random access memory during the waiting state. For this reason, the prior art internal step-down power generator decreases the current passing through the reference voltage generator 1, and the driver 2 is required between the reference voltage generator 1 and the level shifter 3. The driver 2 increases the occupation area, and makes the semiconductor chip large.

SUMMARY OF THE INVENTION

It is therefore an important object of the present invention to provide a constant power voltage generator, which is simple and operative under optimized conditions.

In accordance with one aspect of the present invention, there is provided a constant power voltage generator for producing a first power voltage from a second power voltage higher than the first power voltage comprising a reference voltage generator for producing a reference voltage, a current mirror amplifier having a first input node, a second input node and an output node and responsive to a potential difference between the first input node and the second input node so as to produce a control signal representative of the magnitude of the potential difference at the output node, a variable current source connected between a first power voltage line and a second power voltage line regulated to the second-power voltage and responsive to the control signal so as to vary the amount of current supplied to the first power voltage line in such a manner so as to maintain the first power voltage line to the first power voltage, a first level shifter inserted between the reference voltage generator and the first input node for supplying a first potential level to the first input node and having a series combination of a first step-down element connected between the second power voltage line and a first node, a first constant current source connected between a second node and a third power supply line at a third power voltage difference from the first power voltage and the second power voltage and a first resistive element connected between the first node and the second node and responsive to the reference voltage for determining the first potential level and a second level shifter inserted between the first power voltage line and the second input node for supplying a second potential level to the second input node and having a series combination of a second step-down element connected between the second power voltage line and a third node and a second resistive element electrically connected between the third node and the third power supply line and responsive to the first power voltage so as to determine the second potential level.

BRIEF DESCRIPTION OF THE DRAWINGS

The features and advantages of the constant power voltage generator will be more clearly understood from the following description taken in conjunction with the accompanying drawings in which.

DESCRIPTION OF THE PREFERRED EMBODIMENTS

First Embodiment

Figure 1:
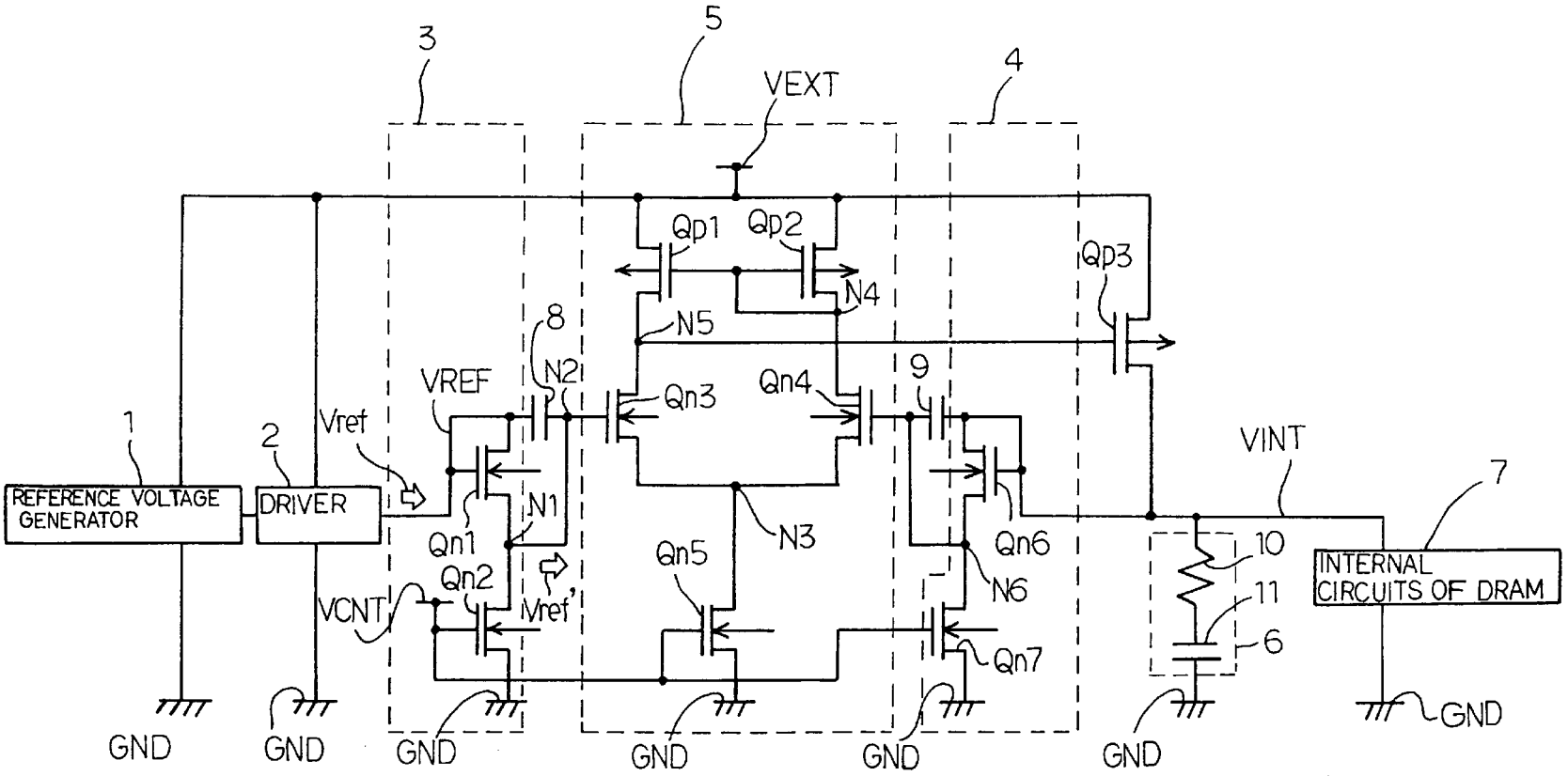
Fig. 1 PRIOR ART
FIG. 1 is a circuit diagram showing the circuit arrangement of the prior art internal step-down power voltage generator disclosed in Japanese Patent Publication of Unexamined Application No. 7-211869.
Figure 2:
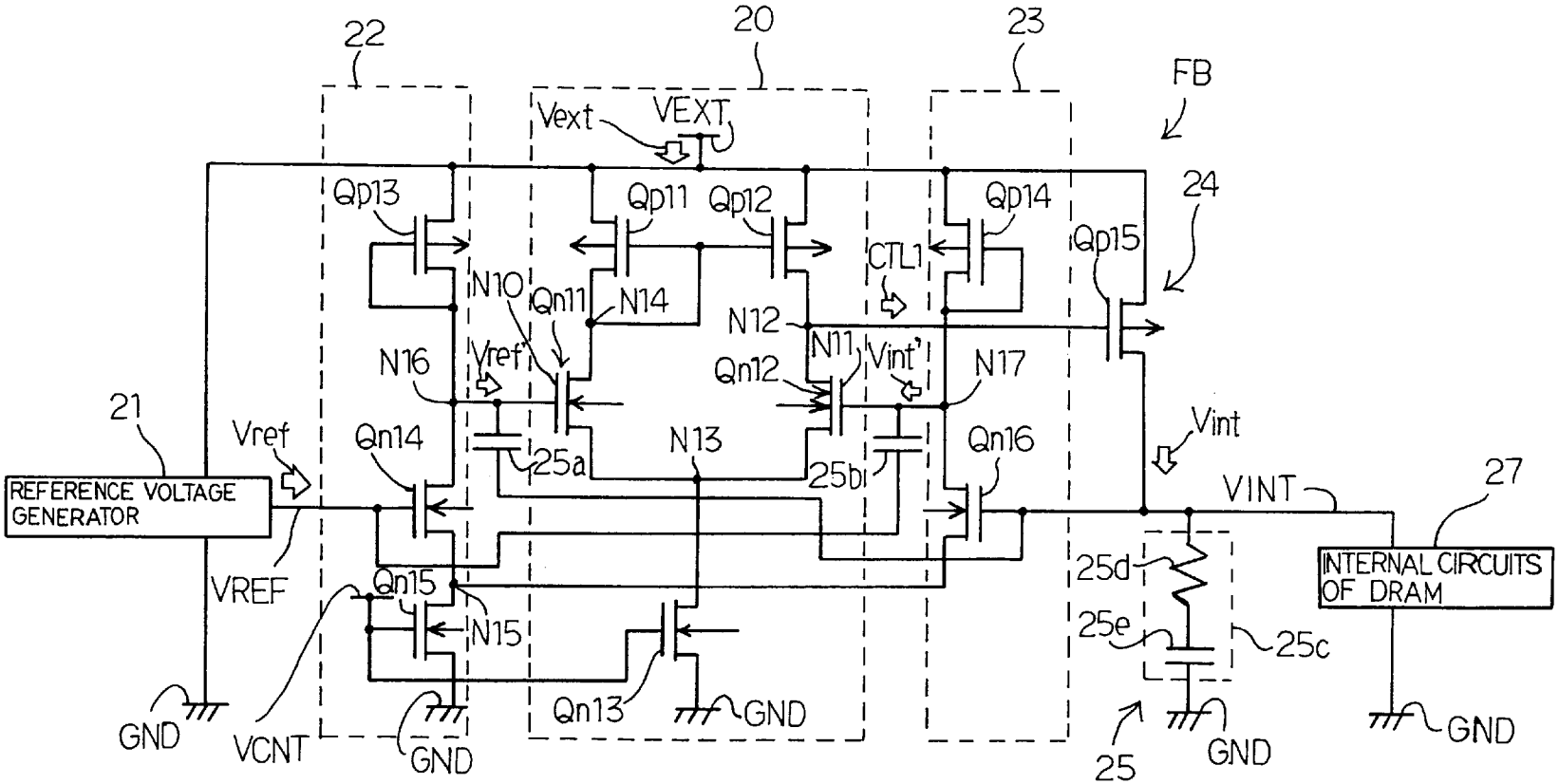
FIG. 2 is a circuit diagram showing the circuit arrangement of a constant power voltage generator according to the present invention.

Referring to FIG. 2 of the drawings, a constant power voltage generator embodying the present invention comprises a current mirror amplifier 20, a reference voltage generator 21, a first level shifter 22 connected between the reference voltage generator 21 and an input node of the current mirror amplifier 20, a second level shifter 23 connected between a step-down power supply line VINT and another input node of the current mirror amplifier 20 and a variable current source 24 connected between an external power supply line VEXT and the step-down power supply line VINT. The level shifters 22/23 pull down a reference voltage Vref and a step-down power voltage Vint, and supply them to the input nodes N10/N11 of the current mirror amplifier 20. The current mirror amplifier 20 increases the magnitude of a potential difference between the input nodes N10 and N11, and supplies a control signal CTL 1 representative of the potential difference to the variable current source 24. The variable current source 24 is responsive to the control signal CTL1 so as to vary the amount of current supplied to the step-down power supply line VINT. With the current, the step-down power supply line VINT is maintained at a step-down power voltage level Vint.

The current mirror amplifier 20 includes a series combination of a p-channel enhancement type field effect transistor Qp11 and an n-channel enhancement type field effect transistor Qn11 connected between the external power supply line VEXT and a common node N13), another series combination of a p-channel enhancement type field effect transistor Qp12 and an n-channel enhancement type field effect transistor Qn12 connected in parallel to the series combination and an n-channel enhancement type field effect transistor Qn13 connected between the common node N13 and a ground line GND.

The gate electrodes of the p-channel enhancement type field effect transistors Qp11/Qp12 are connected to the drain node N14 of the p-channel enhancement type field effect transistor Qp11, and the drain node of the other p-channel enhancement type field effect transistor Qp12 serves as the output node N12. The gate electrode of the n-channel enhancement type field effect transistor Qn13 is connected between the node N13 and the ground line GND, and the gate electrode of the n-channel enhancement type field effect transistor Qn13 is connected to a constant voltage line VCNT.

The n-channel enhancement type field effect transistor Qn13 provides constant resistance against the current passing therethrough, and serves as a constant current source. The gate electrodes of the n-channel enhancement type field effect transistors Qn11/Qn12 serve as the input node N10 and the other input node N11, respectively.

The level shifter 22 includes a series combination of a p-channel enhancement type field effect transistor Qp13, an n-channel enhancement type field effect transistor Qn14 and an n-channel enhancement type field effect transistor Qn15 connected between the external power supply line VEXT and the ground line GND. The gate electrode of the p-channel enhancement type field effect transistor Qp13 is connected to the drain node thereof, and the external power voltage Vext steps down through the p-channel enhancement type field effect transistor Qp13 by the threshold Vtp of the p-channel enhancement type field effect transistor Qp13. The reference voltage Vref is supplied from the reference voltage generator 21 to the gate electrode of the n-channel enhancement type field effect transistor Qn14, and a constant voltage line VCNT is connected to the gate electrode of the n-channel enhancement type field effect transistor Qn15.

The level shifter 23 includes a series combination of a p-channel enhancement type field effect transistor Qp14 and an n-channel enhancement type field effect transistor Qn16 connected between the external power supply line VEXT and the drain node N15 of the n-channel enhancement type field effect transistor Qn15. The gate electrode of the p-channel enhancement type field effect transistor Qp14 is connected to the drain node thereof, and the step-down power supply line VINT is connected to the gate electrode of the n-channel enhancement type field effect transistor Qn16.

The variable current source 24 is implemented by a p-channel enhancement type field effect transistor Qp15. The p-channel enhancement type field effect transistor Qp15 is connected between the external power supply line VEXT and the step-down power supply line VINT, and the output node N12 is connected to the gate electrode of the p-channel enhancement type field effect transistor Qp15. The p-channel enhancement type field effect transistor Qp15 is responsive to the control signal CTL1 so as to vary the amount of current passing therethrough in such a manner as to maintain the step-down power supply line VINT to the step-down power voltage Vint. Thus, the current mirror amplifier 20, the level shifter 23 and the variable current source 24 form a feedback loop FB for the step-down power voltage Vint.

The constant power voltage generator further comprises a compensating circuit 25, and the compensating circuit 25 prevents the current mirror amplifier 20 and the feedback loop FB from the phase difference and undesirable oscillation. The compensating circuit 25 includes phase compensating capacitor 25*a*/25*b* and a phase compensator 25*c*. The phase compensating capacitor 25*a* is connected between the input node N10 and the gate electrode of the n-channel enhancement type field effect transistor Qn16, and the other phase compensating capacitor 25*b* is connected between the other input node N11 and the gate electrode of the n-channel enhancement type field effect transistor Qn14. The phase compensating capacitors 25*a*/25*b* eliminates phase delay from reference voltage Vref' and step-down power voltage Vint'. In other words, the phase compensating capacitors 25*a*/25*b* supply the reference voltage Vref' and the step-down power voltage Vint' to the current mirror amplifier 20 as if they are direct current in a high frequency range.

The phase compensator 25*c* includes a resistor 25*d* and a capacitor 25*e* connected between the step-down power supply line VINT and the ground line GND. The phase compensator 25*c* prevents the feedback loop FB from undesirable oscillation.

In this instance, the p-channel enhancement type field effect transistors Qp13/Qp14, the n-channel enhancement type field effect transistor Qn15 and the n-channel enhancement type field effect transistors Qn14/Qn16 serve as first/second step-down elements, a first constant current source and first/second resistive elements, respectively, and the p-channel enhancement type field effect transistor Qp15 serves as a variable current source. In this instance, the step-down power voltage Vint is supplied to internal circuits 27 of a semiconductor dynamic random access memory device.

The constant power voltage generator behaves as follows. The reference voltage generator 21 supplies the reference voltage Vref to the gate electrode of the n-channel enhancement type field effect transistor Qn14, and the channel resistance of the p-channel enhancement type field effect transistor Qp13, the channel resistance of the n-channel enhancement type field effect transistor Qn14 and the channel resistance of the n-channel enhancement type field effect transistor Qn15 determine the reference voltage Vref' at a node N16. For this reason, the reference voltage Vref' is adjustable to the optimum level by changing the channel resistance of each field effect transistor Qp13/Qn14/Qn15 or changing the reference voltage Vref. The channel resistance is varied by changing the dimensions of the gate electrode or changing the dopant concentration in the channel region.

The external power supply line VEXT directly supplies the current to the level shifter 22, and the driver 2 is never required for the constant voltage generator according to the present invention. The reference voltage generator 21 is only required to supply a small amount of current to the gate electrode of the n-channel enhancement type field effect transistor Qn14, and the constant voltage generator according to the present invention occupies only narrow area of a semiconductor chip.

The step-down power voltage Vint is supplied to the n-channel enhancement type field effect transistor Qn16, and the resistance of the p-channel enhancement type field effect transistor Qp14 and the resistance of the n-channel enhancement type field effect transistors Qn16/Qn15 determines the step-down voltage Vint' at an intermediate node N17 therebetween. The reference voltage Vref' and the step-down power voltage Vint' are respectively supplied to the input nodes N10 and N11, and the current mirror amplifier 20 increases the magnitude of potential difference between the reference voltage Vref' and the step-down power voltage Vint'. The magnitude of the potential difference is converted to the potential level at the output node N12, and the control signal CTL1 is supplied from the output node N12 to the gate electrode of the p-channel enhancement type field effect transistor Qp15. The p-channel enhancement type field effect transistor Qp15 is responsive to the control signal Vint' so as to vary the current supplied to the step-down power supply line VINT, and regulates the step-down power voltage Vint to the target level equal to the reference voltage Vref.

The n-channel enhancement type field effect transistor Qn14 makes the reference voltage Vref' 180 degrees different from the reference voltage Vref, and the reference voltage Vref' at the input node N10 is inverted in phase to that of the prior art. The n-channel enhancement type field effect transistor Qn16 also makes the step-down power voltage Vint' 180 degrees different from the step-down power voltage on the power supply line VINT.

The phase compensating capacitors 25*a*/25*b* make the reference Vref' and the step-down power voltage Vint' in-phase to the step-down power voltage Vint and the reference voltage Vref, respectively, and can compensate phase delay from a low frequency to a high frequency. Thus, the constant power voltage generator achieves phase characteristics equivalent to a constant power voltage generator without the level shifters 22/23.

Figure 3:
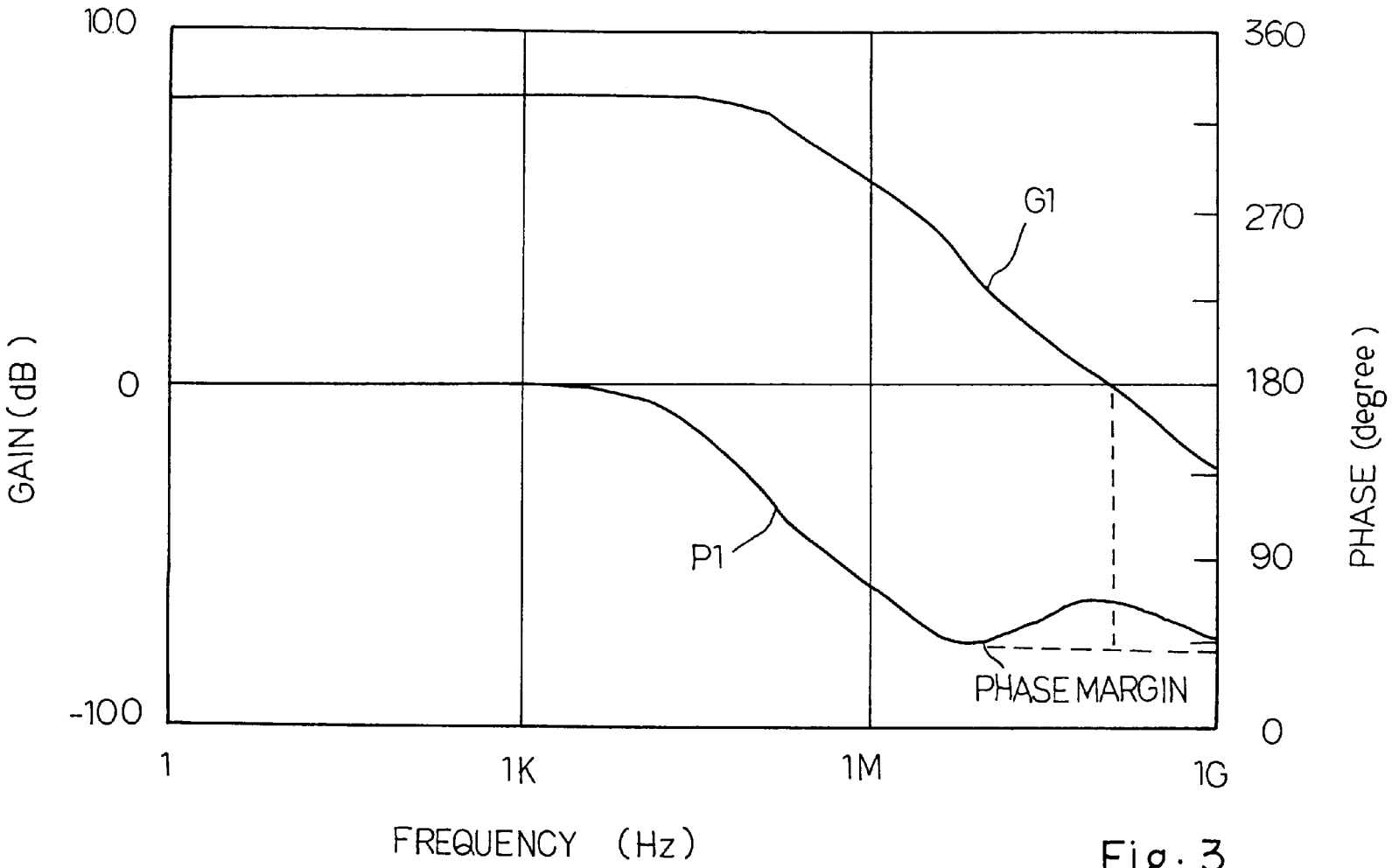
FIG. 3 is a graph showing a gain and a phase difference of a feedback loop incorporated in the constant power voltage generator in terms of frequency.

FIG. 3 illustrates frequency characteristics of the feedback loop FB. The gain and the phase delay are respectively indicated by plots G1 and plots P1 in terms of the frequency. The feedback loop FB is prevented from oscillation under the conditions that the phase margin is equal to or greater than 45 degrees at the gain of 0 dB. As shown in FIG. 3, the feedback loop FB achieves the phase margin greater than 45 degrees at 0 dB by virtue of the phase compensator 25*c*.

As will be understood from the fore going description, the p-channel enhancement type field effect transistor Qp13 and the n-channel enhancement type field effect transistors, Qn14/Qn15 determine the reference voltage Vref' through the proportional allotment on the potential difference between the external power voltage Vext and the ground level, and the reference voltage level Vref' is easily optimized by changing the channel resistance of these field effect transistors Qp13/Qn14/Qn15 or changing the reference voltage Vref. The step-down power voltage Vint' is also easily regulable. As a result, the current mirror amplifier 20 is operative under the optimum conditions.

The level shifters 22/23 are directly powered with the external power voltage Vext, and any driver circuit is not required between the reference voltage generator 21 and the level shifter 22. For this reason, the circuit arrangement is simpler than that of the prior art power generator, and, accordingly, occupies the real estate of a semiconductor chip narrower than that of the prior art.

Second Embodiment

Figure 4:
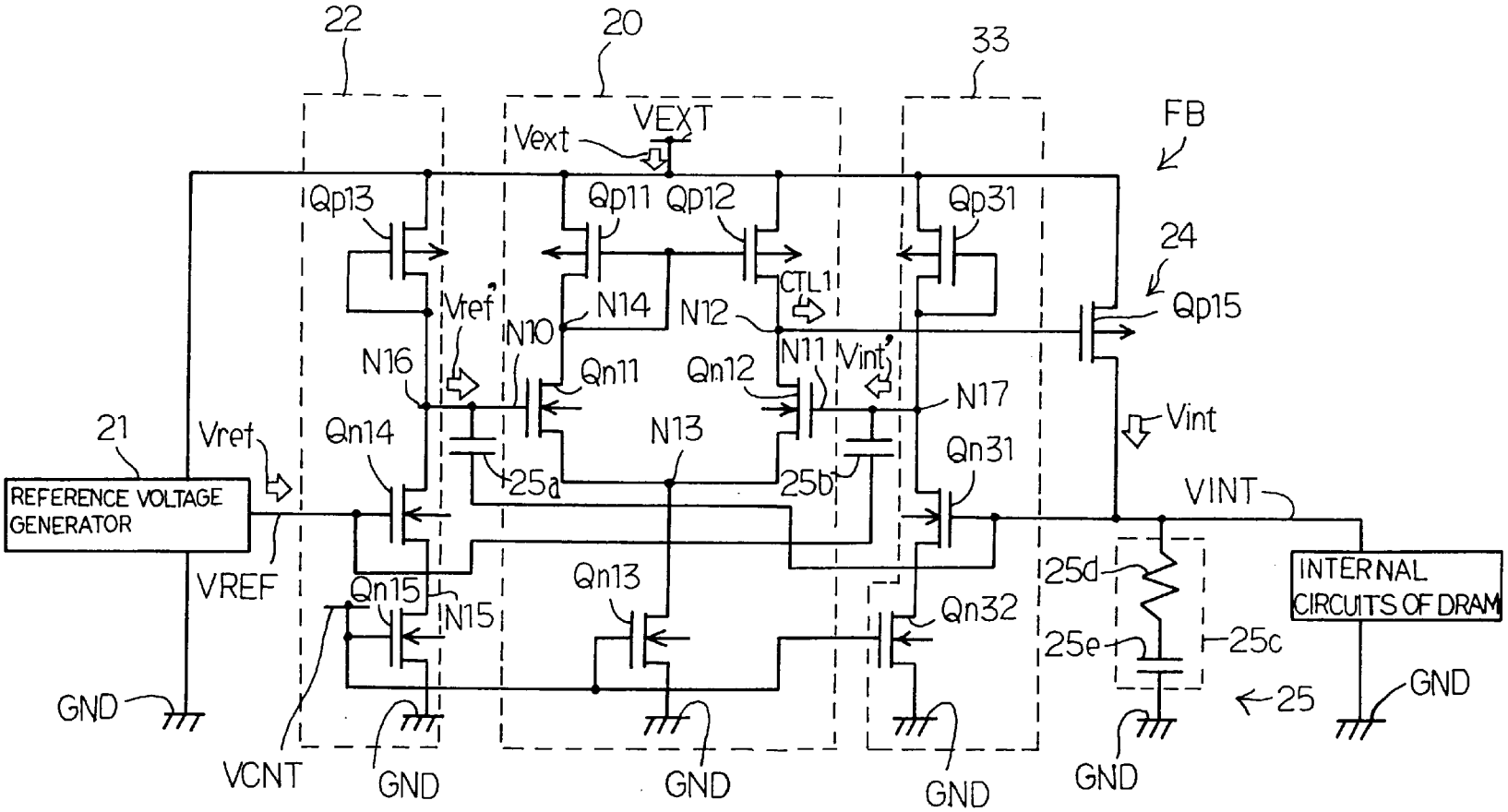
FIG. 4 is a circuit diagram showing the circuit arrangement of another constant power voltage generator according to the present invention.

FIG. 4 illustrates another constant voltage generator embodying the present invention. The constant voltage generator embodying the second embodiment is similar to the first embodiment except for the circuit configuration of a level shifter 33. For this reason, the other circuit and the circuit components are labeled with the same references designating corresponding circuits and corresponding circuit components without detailed description.

The level shifter 33 includes a series combination of p-channel enhancement type field effect transistor Qp31 and n-channel enhancement type field effect transistors Qn31/Qn32 connected between the external power supply line VEXT and the ground line GND. The gate electrode of the p-channel enhancement type field effect transistor Qp31 is connected to the drain node thereof, and the n-channel enhancement type field effect transistor Qn31 is connected to the step-down power supply line VINT. The constant power supply line VCNT is connected to the gate electrode of the n-channel enhancement type field effect transistor Qn32. Thus, the level shifters 22/33 have respectively constant current sources Qn15/Qn32.

The constant power generator implementing the second embodiment behaves as similar to the first embodiment. However, the current at the node N16 is different from that of the first embodiment. In the first embodiment, when the step-down power voltage Vint rises, the n-channel enhancement type field effect transistor Qn16 increases the amount of current passing therethrough, and causes the n-channel enhancement type field effect transistors Qn14/Qn16 to raise the source voltage levels. The phase compensating capacitor 25*a* pulls up the potential level at the node N16 so as to make the source and drain voltages of the n-channel enhancement type field effect transistor Qn14 in-phase.

On the other hand, the n-channel enhancement type field effect transistors Qn14/Qn31 are not commonly connected to the n-channel enhancement type field effect transistor Qn15, but are connected to the n-channel enhancement type field effect transistors Qn15/Qn32, respectively. For this reason, the n-channel enhancement type field effect transistors Qn14/Qn31 regulate the output node N16 of the level shifter 22 are regulated to a constant voltage in a low frequency range. Although the p-channel enhancement type field effect transistor Qp13 introduces phase difference of 90 degrees between the reference voltage Vref on the reference line VREF and the reference voltage Vref' at the output node N16, the gain is extremely small in the low frequency range, and the influence is negligible. However, the gain is increased in a high frequency range, and the influence of the phase difference is never ignoreable. The phase delay of 90 degrees makes the phase in the high frequency range recovered.

Figure 5:
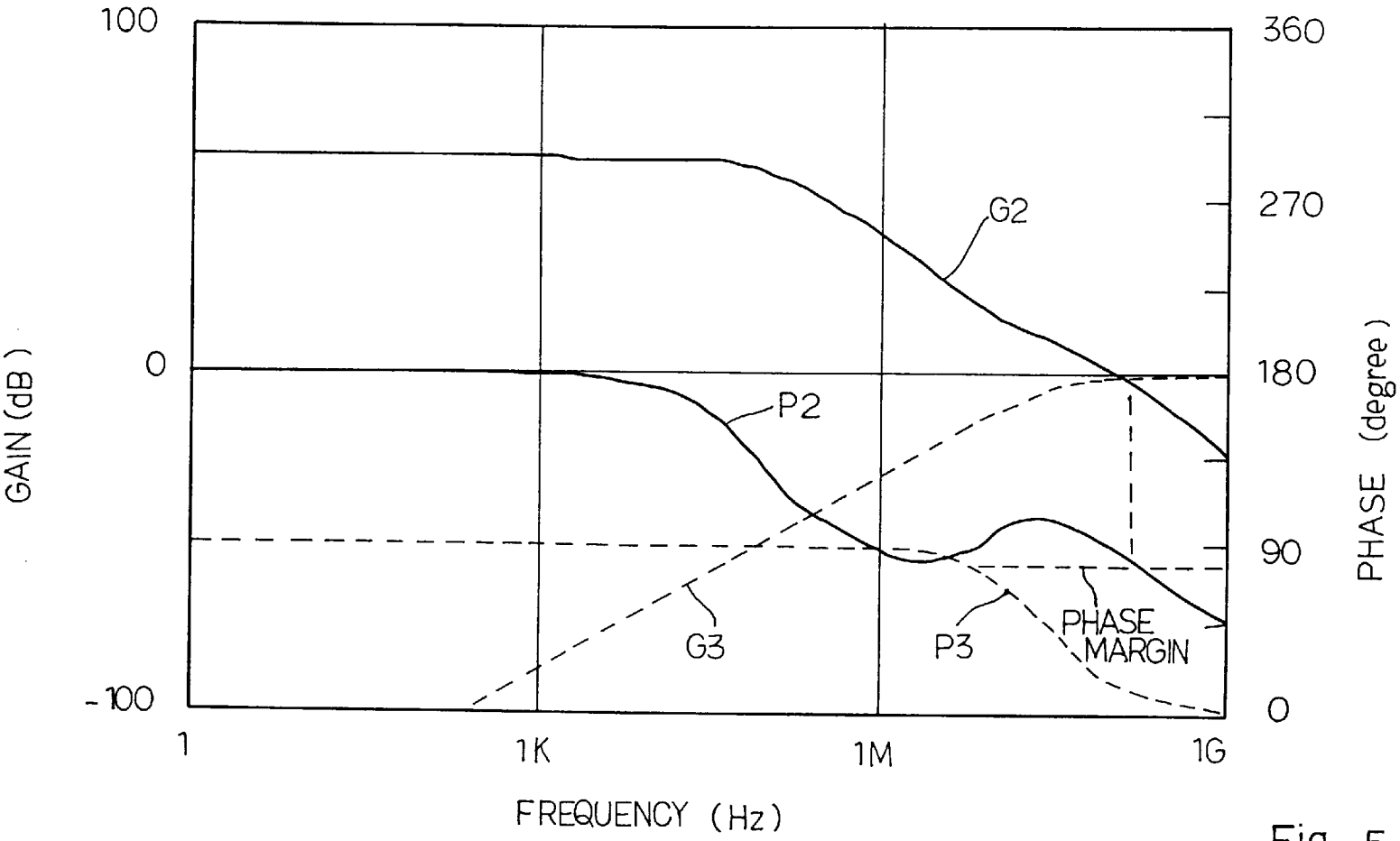
FIG. 5 is a graph showing gains and phase differences in terms of the frequency.

FIG. 5 illustrates the gain G2 and the phase difference P2 of the feed-back loop FB and the gain G3 and the phase difference P3 between the reference voltage Vref' and the step-down power voltage Vint in terms of the frequency. The gain G3 is extremely small in the low frequency range, and the influence on the gain G2 and the phase difference P2 is ignoreable. However, the gain G3 becomes non-ignoreable around 1 MHz, and the phase delay of the feedback loop FB is recovered. As a result, the phase margin is improved to 85 degrees.

Third Embodiment

Figure 6:
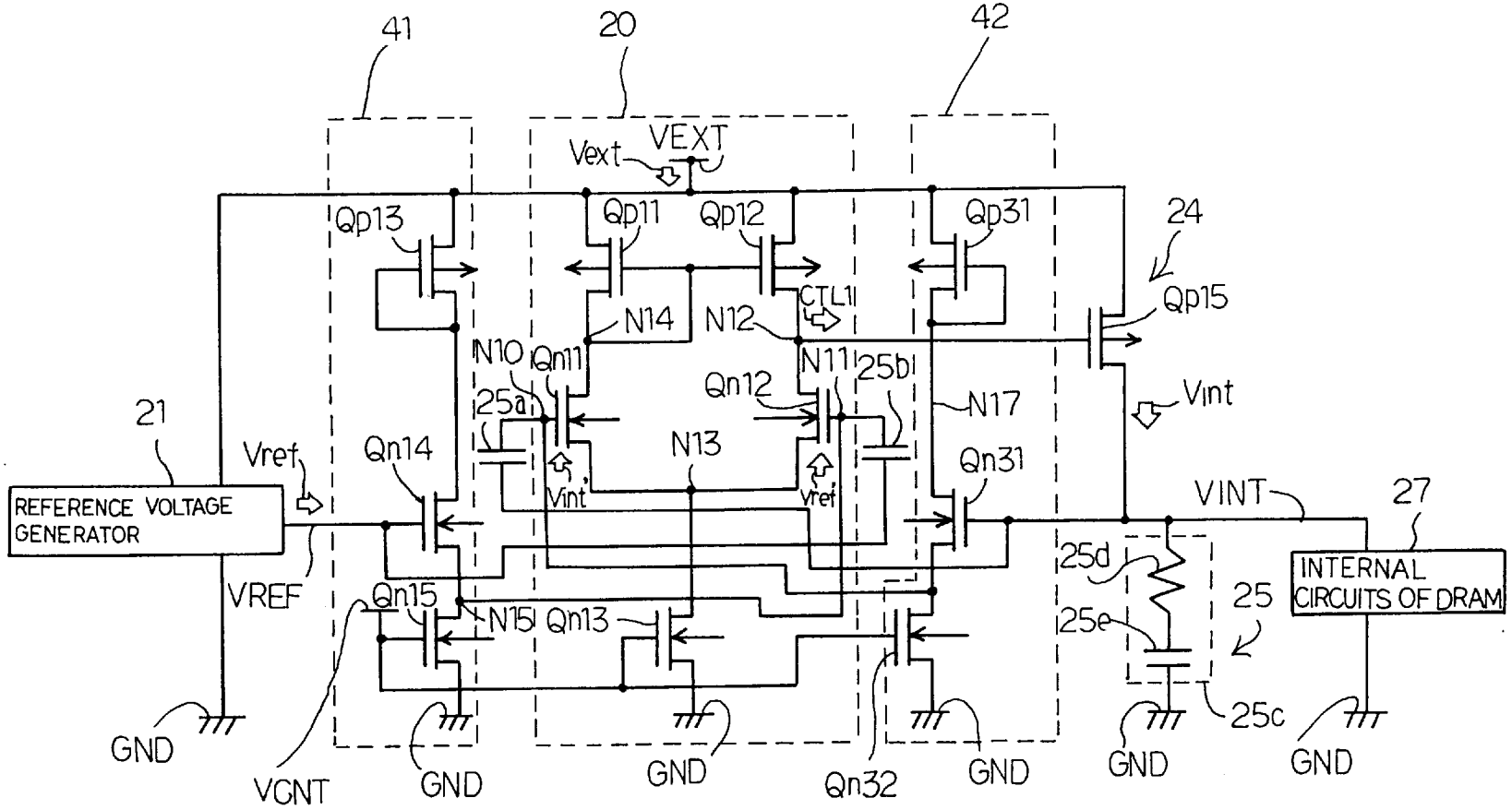
FIG. 6 is a circuit diagram showing the circuit arrangement of yet another constant power voltage generator according to the present invention.

FIG. 6 illustrates yet another constant power voltage generator embodying the present invention. The constant power voltage generator implementing the third embodiment is similar to the second embodiment except for level shifter 41/42. For this reason, the other circuits and the circuit components are labeled with the same references designating corresponding circuits and circuit components of the second embodiment without detailed description.

As similar to the level shifters 22/33, the level shifter 41 includes the series of the p-channel enhancement type field effect transistor Qp13, the n-channel enhancement type field effect transistor Qn14 and the n-channel enhancement type field effect transistor Qn15, and the level shifter 42 includes the series of the p-channel enhancement type field effect transistor Qp31, the n-channel enhancement type field effect transistor Qn31 and the n-channel enhancement type field effect transistor Qn32. However, the input node N11 and the input node N10 are respectively connected to the source node of the n series of the p-channel enhancement type field effect transistor Qp14 and the source node of the n-channel enhancement type field effect transistor Qn31 .

The reference voltage Vref' and the step-down power voltage Vint' are in-phase to the reference voltage Vref and the step-down power voltage Vint'. For this reason, the reference voltage Vref' and the step-down power voltage Vint' are supplied to the input node N11 and the other input node N10, respectively.

The connection between the level shifters 41/42 and the current mirror amplifier 20 makes the reference voltage Vref' and the step-down power voltage Vint' lower than those of the second embodiment. If the optimum operating levels of the current mirror amplifier 20 are lower than those of the second embodiment, the level shifters 41/42 are desirable.

Fourth Embodiment

Figure 7:
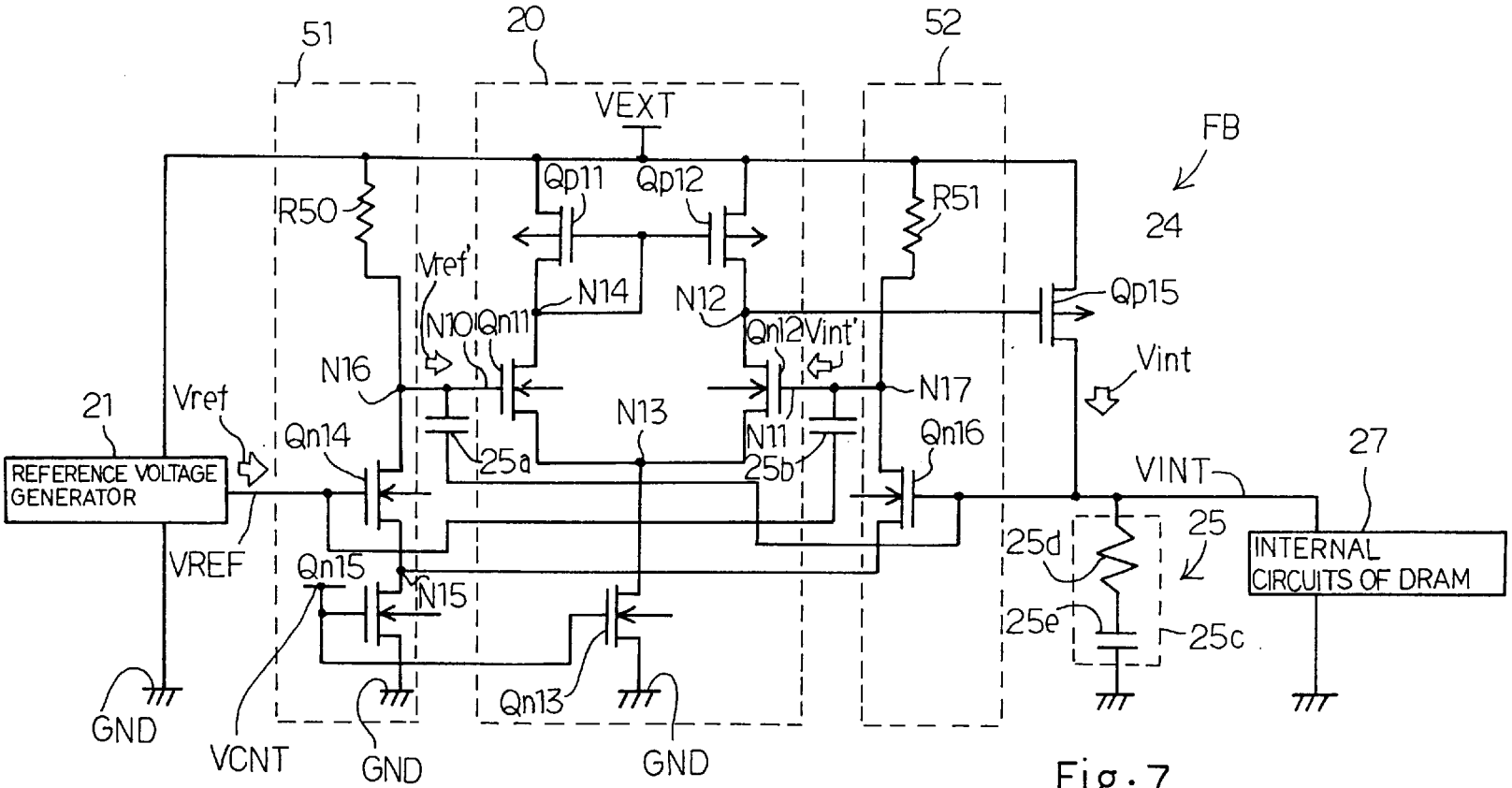
FIG. 7 is a circuit diagram showing the circuit arrangement of still another constant power voltage generator according to the present invention.

FIG. 7 illustrates still another constant power voltage generator embodying the present invention. The constant power voltage generator implementing the fourth embodiment is similar to the first embodiment except for level shifter 51/52. For this reason, the other circuits and the circuit components are labeled with the same references designating corresponding circuits and circuit components of the first embodiment without detailed description.

In the level shifters 51/52, the p-channel enhancement type field effect transistors Qp13/Qp31 are replaced with resistors R50/R51, and the resistors R50/R51 are connected to the series of the n-channel enhancement type field effect transistors Qn14/Qn15 and the n-channel enhancement type field effect transistor Qn16, respectively.

The reference voltage Vref' and the step-down power voltage Vint' are optimized by changing the resistance of the resistors R50/R51, and a designer does not change the transistor size of the n-channel enhancement type field effect transistors Qn14/Qn16.

As will be appreciated from the foregoing description, the resistance of the circuit components of the level shifters determines the reference voltage level Vref' and the step-down power voltage Vint' through the proportional allotment on the potential difference between the power supply lines, and the reference voltage Vref' and the step-down voltage Vint' are easily optimized for the current mirror amplifier. Moreover, the level shifters are directly powered with the external power voltage Vext, and any driver circuit is not required between the reference voltage generator and the level shifter. For this reason, the circuit arrangement is simpler than that of the prior art power generator, and, accordingly, occupies the real estate of a semiconductor chip narrower than that of the prior art.

Although particular embodiments of the present invention have been shown and described, it will be obvious to those skilled in the art that various changes and modifications may be made without departing from the spirit and scope of the present invention.

For example, the constant power voltage generator according to the present invention is applicable to any kind of integrated circuit device.

Each of the resistors R50/R51 is replaceable with a series of diodes or diode-connected transistors. The p-channel enhancement type field effect transistor Qp13/Qp14 is also replaceable with the series of diodes or the diode-connected transistors. In this instance, the diode or the diode-connected transistor is added to or deleted from the series combination so as to change the potential level at the node N16/N17.

The resistors R50/R51 or the series of diodes/diode-connected transistors is available for the second embodiment and the third embodiment.

Finally, the reference voltage Vref may be negative. In this instance, the n-channel enhancement type field effect transistors Qn14/Qn16 may be replaced with p-channel enhancement type field effect transistors.

What is claimed is:

1. A constant power voltage generator for producing a first power voltage from a second power voltage higher than the first power voltage, comprising:

a reference voltage generator for producing a reference voltage;

a current mirror amplifier having a first input node, a second input node and an output node, and responsive to a potential difference between said first input node and said second input node so as to produce a control signal representative of the magnitude of said potential difference at said output node;

a variable current source connected between a first power voltage line and a second power voltage line regulated to said second power voltage, and responsive to said control signal so as to vary the amount of current supplied to said first power voltage line in such a manner so as to maintain said first power voltage line to said first power voltage;

a first level shifter inserted between said reference voltage generator and said first input node for supplying a first potential level to said first input node, and having a series combination of a first step-down element connected between said second power voltage line and a first node, a first constant current source connected between a second node and a third powers voltage line at a third power voltage difference from said first power voltage and said second power voltage and a first resistive element connected between said first node and said second node and responsive to said reference voltage for determining said first potential level; and a second level shifter inserted between said first power voltage line and said second input node for supplying a second potential level to said second input node, and having a series combination of a second step-down element connected between said second power voltage line and a third node and a second resistive element electrically connected between said third node and said third power voltage line and responsive to said first power voltage so as to determine said second potential level.

2. The constant power voltage generator as set forth in claim 1, in which said second resistive element is connected at one end to said third node and at the other end to said second node.

3. The constant power voltage generator as set forth in claim 2, in which said first potential level and said second potential level are supplied from said first node and said third node to said first input node and said second input node, respectively.

4. The constant power voltage generator as set forth in claim 2, in which field effect transistors serve as said first resistive element and said second resistive element, respectively.

5. The constant power voltage generator as set forth in claim 4, in which said second power voltage line and said third power voltage line propagate a positive power voltage and a ground voltage to said first level shifter and said second level shifter, and said field effect transistors are operative in an n-channel enhancement mode.

6. The constant power voltage generator as set forth in claim 1, in which said second resistive element is connected at one end to said third node and at the other end to said third power voltage line through a second constant current source.

7. The constant power voltage generator as set forth in claim 6, in which said first potential level and said second potential level are supplied from said second node and a fourth node between said second resistive element and said second constant current source to said second input node and said first input node, respectively.

8. The constant power voltage generator as set forth in claim 6, in which field effect transistors serve as said first resistive element and said second resistive element, respectively.

9. The constant power voltage generator as set forth in claim 8, in which said second power voltage line and said third power voltage line propagate a positive power voltage and a ground voltage to said first level shifter and said second level shifter, and said field effect transistors are operative in an n-channel enhancement mode.

10. The constant power voltage generator as set forth in claim 1, in which field effect transistors serve as said first step-down element and said second step-down element, respectively.

11. The constant power voltage generator as set forth in claim 10, in which said second power voltage line and said third power voltage line propagate a positive power voltage and a ground voltage to said first level shifter and said second level shifter, and said field effect transistors are operative in a p-channel enhancement mode.

12. The constant power voltage generator as set forth in claim 1, in which resistors serve as said first step-down element and said second step-down element, respectively.

13. The constant power voltace generator as set forth in claim 1, further comprising a first phase compensating circuit for decreasing a phase delay from variation of said first and second potential levels.

14. The constant power voltage generator as set forth in claim 13, in which said first phase compensating circuit includes a first capacitor for decreasing said phase delay between said reference voltage and said first potential level and a second capacitor for decreasing said phase delay between said first power voltage and said second potential level.

15. The constant power voltage generator as set forth in claim 14, in which said first capacitor and said second capacitor are connected between said first power voltage line and said first input node and between said reference voltage generator and said second input node, respectively, and said first node and said third node are connected to said first input node and said second input node, respectively.

16. The constant power voltage generator as set forth in claim 14, in which said first capacitor and said second capacitor are connected between said first power voltage line and said first input node and between said reference voltage generator and said second input node, respectively, and said second input node and said first input node are respectively connected to said second node and a second constant current source connected between said second resistive element and said third power voltage line.

17. The constant power voltage generator as set forth in claim 13, further comprising a second phase compensating circuit connected between said first power voltage line and said third power voltage line for preventing a feedback loop having said current mirror amplifier, said variable current source and said second level shifter from oscillation.

18. The constant power voltage generator as set forth in claim 17, in which said first phase compensating circuit includes a first capacitor for decreasing said phase delay between said reference voltage and said first potential level and a second capacitor for decreasing said phase delay between said first power voltage and said second potential level, and said second phase compensating circuit includes a series combination of a resistive element and a third capacitor connected between said first power voltage line and said third power voltage line.

19. The constant power voltage generator as set forth in claim 17, in which said first power voltage is supplied to internal circuits of a semiconductor dynamic random access memory device.

* * * * *